United States Patent [19]

Thiessens et al.

[11] 4,020,439

[45] Apr. 26, 1977

[54] INDUCTIVE STABILIZING BALLAST FOR A GAS AND/OR VAPOR DISCHARGE LAMP

[75] Inventors: Alexander Joseph Gerardus Thiessens; Leonard Woldring, both of Emmasingel, Netherlands

[73] Assignee: U.S. Philips Corporation, New York, N.Y.

[22] Filed: Nov. 13, 1975

[21] Appl. No.: 631,737

Related U.S. Application Data

[62] Division of Ser. No. 542,838, Jan. 21, 1975, Pat. No. 3,947,955.

[30] Foreign Application Priority Data

Feb. 9, 1974 Netherlands ..... 7401806

[52] U.S. Cl. ..... 336/61; 336/83; 336/234

[51] Int. Cl.[2] ..... H01F 27/08; H01F 27/26

[58] Field of Search ..... 336/83, 61, 212, 165, 336/178, 234

[56] References Cited

UNITED STATES PATENTS

| | | | |
|---|---|---|---|
| 1,170,201 | 2/1916 | Weed | 336/234 X |
| 1,471,263 | 10/1923 | Hobart | 336/234 X |
| 1,642,470 | 9/1927 | Welch | 336/234 X |
| 1,644,729 | 10/1927 | Johannesen | 336/234 X |

FOREIGN PATENTS OR APPLICATIONS

| | | | |
|---|---|---|---|
| 1,052,592 | 3/1959 | Germany | 336/83 |

*Primary Examiner*—Thomas J. Kozma
*Attorney, Agent, or Firm*—Frank R. Trifari; Bernard Franzblau

[57] ABSTRACT

The invention relates to a method of manufacturing an inductive stabilizing ballast for a gas and/or vapor discharge lamp.

According to the invention, after placing the laminations in and about the coil, part of each lamination is turned about an axis which is parallel to the center line of the electric coil so that the lamination parts are tightly turned against the electric coil. This leads to a satisfactory thermal contact between the coil and the casing so that the removal of heat from the coil is enhanced.

10 Claims, 8 Drawing Figures

INDUCTIVE STABILIZING BALLAST FOR A GAS AND/OR VAPOR DISCHARGE LAMP

This is a division of application Ser. No. 542,838, filed Jan. 21, 1975 now U.S. Pat. No. 3,947,955.

The invention relates to a method of manufacturing an inductive stabilizing ballast for a gas and/or vapour discharge lamp. The ballast is of the casing type and is composed of an electric coil and at least one pack of mutually substantially equal laminations engaging one another over the largest part of their surface. At least part of each lamination is turned about an axis after placing said laminations about the electric coil. The invention also relates to an inductive stabilizing ballast manufactured by means of this method.

A known method of the kind mentioned above is described, for example, in German Utility Model No. 1849769. In this known method the laminations parts are turned so as to adjust the size of the airgap of the inductive stabilizing ballast. A drawback of a stabilizing ballast manufactured by this known method is the poor quality of the mechanical contact between the lamination pack and the outer side of the electric coil. This means that the heat from the coil in this known inductive stabilizing ballast can be rather poorly conducted away.

An object of the invention is to provide a method of the above-mentioned kind so as to realize an inductive stabilizing ballast in which the heat from the electrical coil can be conducted away satisfactorily.

According to the invention a method of manufacturing an inductive stabilizing ballast for a gas and/or vapour discharge lamp, which ballast is built up of an electric coil and at least one pack of mutually substantially equal laminations engaging one another over the largest part of their surface, in which the ballast is of the casing type and in which, at least part of each lamination is turned about an axis after placing said laminations about the electric coil, is characterized in that said axis is parallel to the centre line of the electric coil and the lamination parts are turned so far that the casing is tightly clamped about the electric coil.

An advantage of this method is that due to the tight clamping of the lamination casing about the electric coil a satisfactory mechanical contact between these parts is obtained so that the removal of heat from the electric coil is enhanced to a great extent.

A further advantage of the method according to the invention is that an inductive stabilizing ballast is obtained having a more slender profile than in the case where the packs are not turned. A slender profile is understood to mean that the rectangular cross-section of the ballast has small dimensions. It is possible to discontinue turning of the lamination parts when the lamination parts are clamped against the coil.

Furthermore it is feasible that the lamination parts are then slightly turned further so that the windings of the electric coil are more closely pressed together. This leads to an even better thermal contact enhancing the cooling of the ballast.

In a preferred embodiment according to the invention the lamination parts, after having been turned so far that the casing tightly clamps about the electric coil, are still further turned about the said axis so that the cross-section of the electric coil undergoes a deformation. The cross-section of the electric coil is understood to mean a cross-section of the coil located in the plane of a winding thereof. This cross-section is, for example, initially rectangular and after its deformation it has, for example, the shape of a parallelogram.

An advantage of this preferred method is that it leads to a still more slender profile of the ballast. This may be useful when designing luminaires for discharge lamps stabilized with these ballasts.

To reduce the air gap of the ballast a second pack of laminations may be used.

In a preferred embodiment according to the invention in which a second pack of mutually substantially equal laminations also is placed about the electric coil, the lamination parts of the second pack are turned about the same axis (axes) simultaneously when the lamination parts of the first pack are turned.

An advantage of this preferred method is that a ballast having both a satisfactory cooling and a small air gap can be obtained in a simple manner.

It is feasible that for each lamination of a pack there applies that the entire lamination is turned over an angle. This is not accompanied by deformation of a lamination. It is, however, alternatively feasible that only part of each lamination is turned. It is also possible for one lamination part to be turned more than another.

In a further preferred embodiment according to the invention in which the turning part of each lamination of a pack of the casing is an end part of this lamination and in which the cross-section of the electric coil is substantially not deformed, a further end part of each lamination of this pack of the casing is turned about a different axis which is also parallel to the center line of the electric coil, while the central part of each lamination is not turned.

An advantage of this preferred method is that possibly lamination parts located within the coil may maintain a reasonable thermal contact with this coil.

In an inductive stabilizing ballast according to the invention each lamination of a pack will generally constitute an angle of 85° at a maximum with the stacking direction of the laminations of this pack. The stacking direction is to be understood to mean the direction indicated by the line on which the central points of these laminations are located. This means that the relevant lamination parts are generally turned over at least 5°. Still smaller turning angles would mean that the clearance between pack and coil is so small that placing the pack about the coil would be complicated.

An inductive stabilizing impedance which is manufactured by means of a method according to the invention may be built up of, for example, a combination of U and I laminations.

Preferably, the laminations are present as a combination of a pack of E-laminations and a pack of T-laminations.

The invention will be described in greater detail with reference to the accompanying drawing in which FIG.f 1 shows a combination of a pack of E-laminations an electric coil and a pack of T-laminations. This combination serves for carrying out a method according to the invention. The three parts are shown in a perspective view.

FIG. 4 is a perspective view of the inductive stabilizing ballast according to the invention of which FIG. 3 is a plan view.

Figure 1:
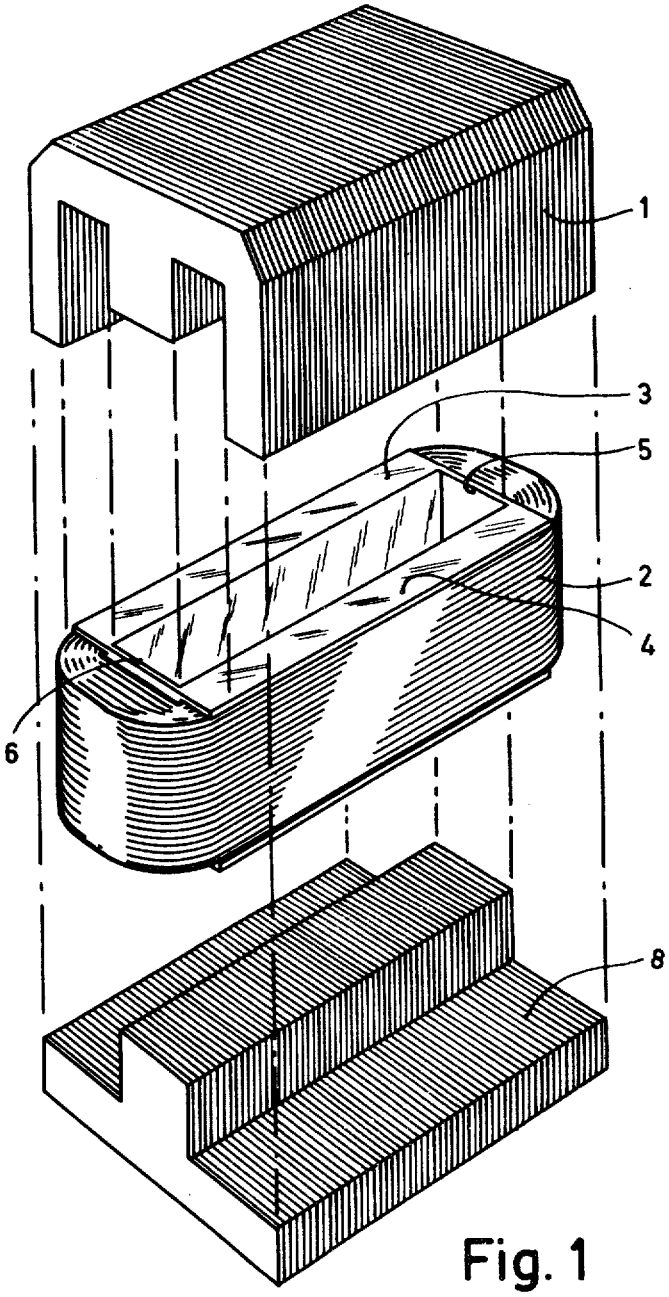

In FIG. 1 the reference numeral 1 denotes a pack of E-laminations. An electric coil 2 having a substantially rectangular cross-section is arranged below this pack. The reference numerals 3 and 4 denote two substantially undeformable U-shaped insulating wall sections which are connected by connection parts 5 and 6. These prevent the sides of the coil from being deformed during manufacture. The parts 5 and 6 may move relative to the parts 3 and 4. The reference numeral 8 denotes a pack of T-laminations.

The method carried out is that with a suitable tool (not shown) the E-laminations are placed about the coil with their side legs straddling the coil 2 and with their central legs inside the coil. Subsequently the lamination pack 8 is moved into the lower side of the coil. This means that the long legs of the E-laminations 1 will engage the T-laminations 8 and that an air gap is formed between the short legs of the pack 1 and the pack 8. This air gap is then present within the coil 2.

Figure 2:
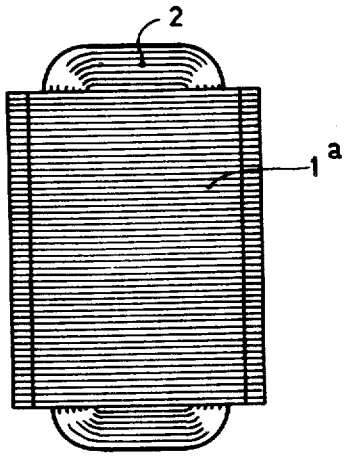
FIG. 2 is a plan view of the part of FIG. 1 after assembly.

In FIG. 2 the reference numeral 1*a* denotes the upper side of the E-lamination pack 1 and reference numeral 2 is the electric coil.

Figure 3:
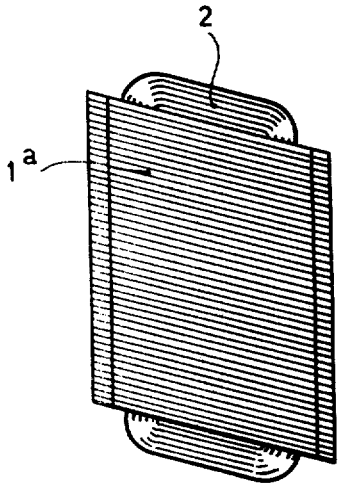
FIG. 3 shows an inductive stabilizing ballast according to the invention in a plan view similar to that of FIG. 2, but in a final stage of manufacture.

Subsequently the E- and T-laminations are turned about the center line of the coil 2 over an angle of approximately 15°. This leads to the situation shown in FIG. 3. The center line of coil 2 is at right angles to the plane of the drawing in FIGS. 2 and 3. It can be seen that during turning the coil 2 also is deformed so that the original substantially rectangular cross-section assumes the shape of a parallelogram. The E- and T-laminations are then secured together, for example, by means of welding or clamping.

Figure 4:
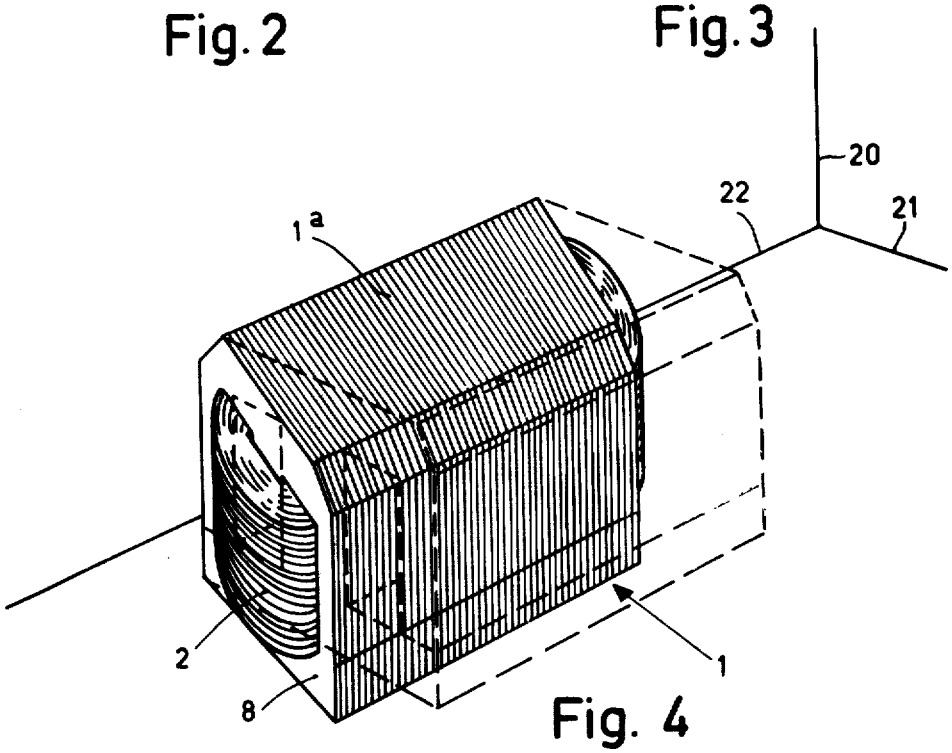

In FIG. 4 all this has been shown in a perspective view where the solid lines show the ultimately obtained inductive stabilizing ballast and the broken lines show the situation before turning of the lamination packs 1 and 8. For the sake of clarification FIG. 4 also shows a cross of axes with three mutually right-angled axes which are denoted by reference numerals 20, 21 and 22, respectively. The dimensions of the ballast thus obtained were approximately 7 × 4 × 3.5 cm.

Figure 5:
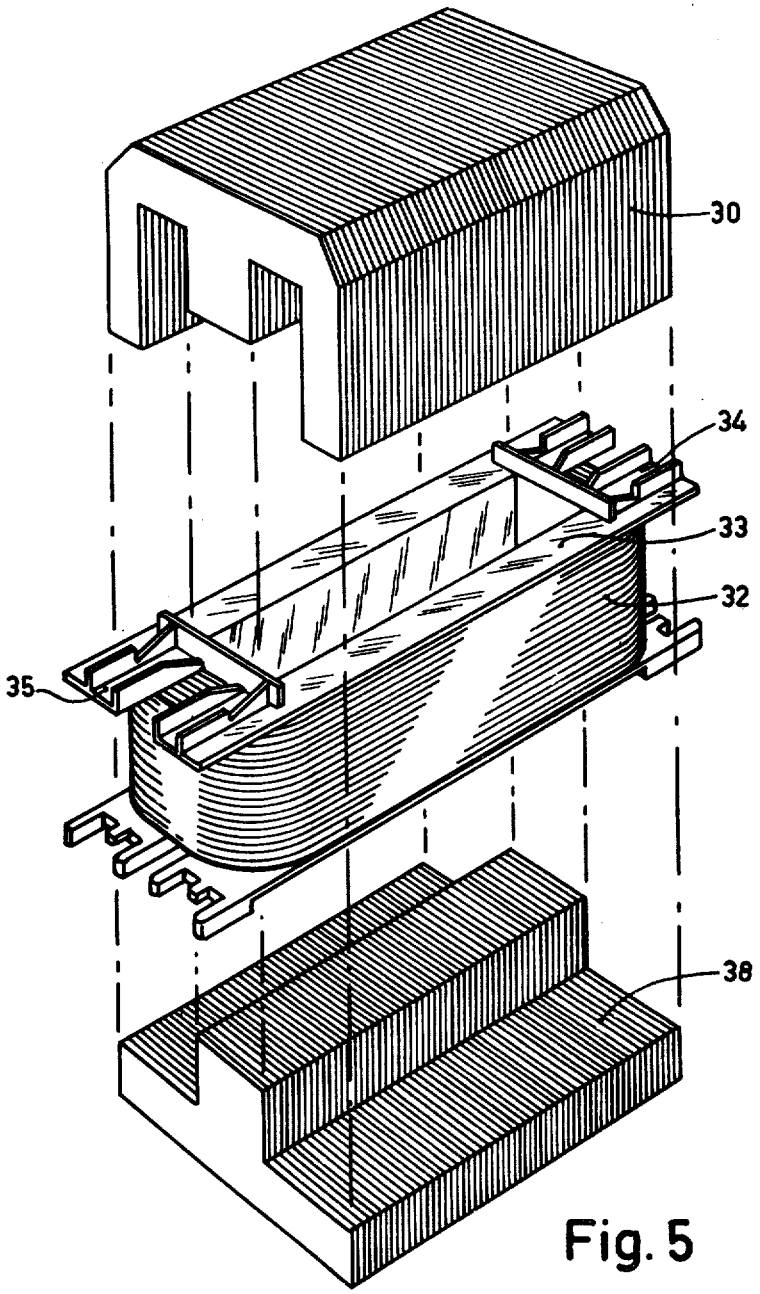
FIG. 5 is a perspective view similar to that of FIG. 1 in which, however, the central part, an electric coil is provided with a coil former that is substantially undeformable.

Similar to the device shown in FIG. 1 a pack of E-laminations 30 and a pack of T-laminations 38 is shown in FIG. 5.

An electric coil 32 in this case envelopes a substantially undeformable coil former 33. Reference numerals 34 and 35 denote connection contacts on the coil former 33.

Figure 6:
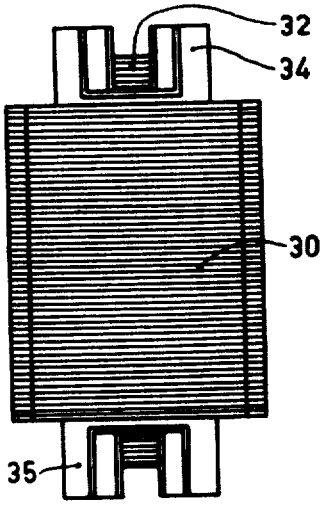
FIG. 6 is a plan view of the combination of the parts of FIG. 5 after assembly.

FIG. 6 is a plan view of the parts of FIG. 5, namely after assembly of the lamination packs 30 and 38 about the electric coil 32.

Figure 7:
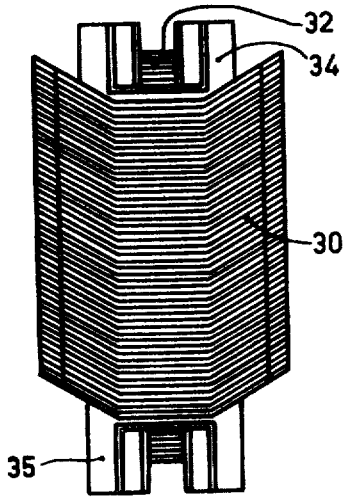
FIG. 7 shows a second inductive stabilizing ballast according to the invention in a plan view similar to that of FIG. 6 but in a final stage of manufacture.

FIG. 7 shows the final stage of manufacture in which one half of end parts of each E-T lamination combination is turned about a first group of axes and the other half of end parts of each E-T lamination combination is turned about a second group of axes so that each lamination is bent twice. The turning angles were approximately 30°. The first and second group of axes are parallel to the center line of the coil 30. In this method the coil former is not deformed. It is achieved that the interior of the E- and T-casing tightly engages the outer side of the electric coil 32. After turning of the lamination parts the E-laminations are again secured to the T-laminations. The finished product is shown in a perspective view of FIG. 8. The dimensions of this product are approximately the same as those of the ballast of FIG. 4.

The described stabilizing ballasts are intended to be connected to an alternating voltage source in series with a gas and/or vapor discharge lamp. Each of the ballasts will then serve for stabilizing the electric current through a lamp of the said type.

Figure 8:
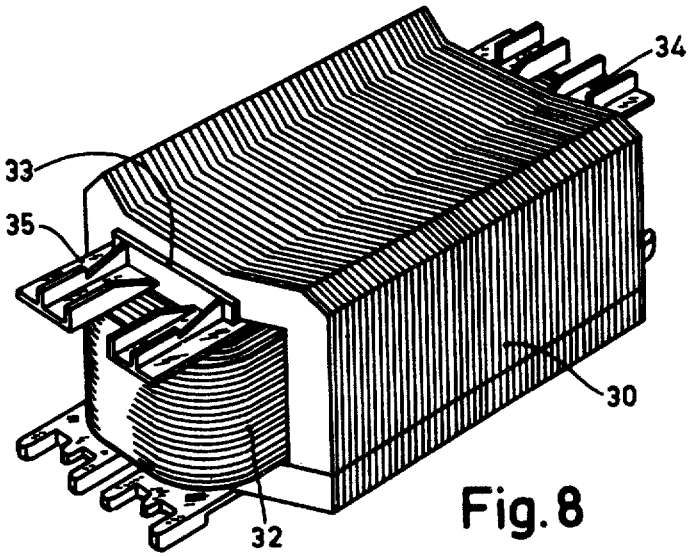
FIG. 8 is a perspective view of the second inductive stabilizing balast according to the invention.

As regards cooling of the coil 32 of FIG. 8 of this inductive stabilizing ballast according to the invention relative to cooling of the same coil of an inductive stabilizing ballast not according to the invention, i.e., without turned laminations, the following can be noted: It was found that at a current intensity of approximately 0.5 ampere through the electric coil the temperature gradient between the electric coil and the outer side of the lamination casing in the case of FIG. 8 (i.e., for a ballast according to the invention) was approximately 15% lower than in a similar ballast in which the laminations were not turned. This means, for example, that the ballast according to the invention can be loaded with a slightly higher electric current. This also means that this ballast may be used in combination with a lamp proportioned for a slightly higher current intensity.

What is claimed is:

1. An inductive device comprising an electric coil, at least one pack of substantially identical parallel arranged laminations engaging one another over the largest part of their surface, the inductive device being of the casing type, said pack of laminations being located parallel to the center line of the electric coil so as to engage and clamp said coil to provide substantial surface contact therebetween a flat part of each of said laminations forming an angle of 85° at a maximum with the stacking direction of the laminations.

2. An inductive device as claimed in claim 1, wherein the cross-section of the coil is approximately a parallelogram.

3. An inductive device as claimed in claim 1, characterized in that all laminations, are planar and the plane of each lamination of the pack constitutes an angle of 85° at a maximum with the stacking direction of the laminations.

4. An inductive device as claimed in claim 1, characterized in that each lamination of the pack has an end part thereof making an angle of 85° at a maximum with the stacking direction of the laminations.

5. An inductive ballast comprising, an electric coil, a plurality of substantially identical parallel arranged laminations engaging one another over the largest part of their surface and located about said electric coil, the ballast being of the casing type with at least a part of each lamination turned about an axis that is parallel to the center line of the electric coil and with the lamination parts turned so far that the laminations are tightly clamped about the electrical coil to provide substantial surface contact therebetween.

6. An inductive ballast as claimed in claim 5 wherein said laminations comprise flat plates arranged so that a flat part of each of said laminations makes an angle of 85° at a maximum with the stacking direction of the laminations.

7. An inductive ballast as claimed in claim 5 wherein said plurality of laminations comprises a first stack of similar E-shaped laminations and a second stack of similar T-shaped laminations, said first and second stacks of laminations being positioned about the coil so that the center parts of the E- and T-shaped laminations are juxtaposed within the coil window to form an air gap therebetween and the outer parts of said laminations substantially surround the coil to form a closed magnetic path except for said air gap.

8. An inductive ballast as claimed in claim 5 wherein the lamination parts are turned so far about said axis such that the cross-section of the coil is deformed from its original shape.

9. An inductive ballast as claimed in claim 5 further comprising a second plurality of substantially identical parallel arranged laminations located about said electric coil, and wherein lamination parts of the second plurality of laminations are turned about said axis simultaneously with the turning of the lamination parts of the first plurality of laminations so that the coil is tightly clamped by both sets of laminations.

10. An inductive ballast as claimed in claim 5 wherein the turned lamination parts comprise one end part of each lamination which is turned about a first axis parallel to the center line of the coil and a second end part of each lamination which is turned about a second different axis which is also parallel to the center line of the coil while the central part of each lamination is not turned, whereby the cross-section of the coil is substantially not deformed.

* * * * *